United States Patent [19]

Tokunaga et al.

[11] 4,112,346

[45] Sep. 5, 1978

[54] CONSTANT CURRENT CIRCUIT

[75] Inventors: Michio Tokunaga, Zushi; Ichiro Ohhinata, Yokohama; Shinzi Okuhara, Fujisawa, all of Japan

[73] Assignee: Hitachi, Ltd., Japan

[21] Appl. No.: 823,197

[22] Filed: Aug. 9, 1977

[30] Foreign Application Priority Data

Aug. 11, 1976 [JP] Japan ..... 51-94881

[51] Int. Cl.[2] ..... G05F 1/56

[52] U.S. Cl. ..... 323/4; 307/297; 307/299 B

[58] Field of Search ..... 323/1, 4, 9, 22 T; 307/296 R, 297, 299 B, 313

[56] References Cited

U.S. PATENT DOCUMENTS 3,714,543 1/1973 Sahara et al. ..... 323/4

4,063,120 12/1977 Idei ..... 307/297

FOREIGN PATENT DOCUMENTS 157,044 12/1975 Japan ..... 323/4

OTHER PUBLICATIONS

"Current Source" by Platt & Pomeranz; IBM Tech. Disc. Bull., vol. 14, No. 5, Oct. 1971, p. 1495.

*Primary Examiner*—Gerald Goldberg

*Attorney, Agent, or Firm*—Craig & Antonelli

[57] ABSTRACT

A constant current circuit includes two characteristic-correlated PNP transistors connected to a constant voltage source and having common-connected emitters and common-connected bases and an NPN transistor. A constant current is taken out of a collector of a first PNP transistor. A collector of a second PNP transistor is connected to a base of the NPN transistor and the common-connected emitters of the first and second PNP transistors is connected to a collector of the NPN transistor to form a negative feedback circuit in the first PNP transistor, whereby when a current gain of the second PNP transistor which is characteristic corelated to the first PNP transistor is high a large amount of feedback is applied and when the current gain is low a small amount of feedback is applied so that the magnitude of the output constant current taken from the collector of the first PNP transistor is adjusted.

7 Claims, 5 Drawing Figures

CONSTANT CURRENT CIRCUIT

LIST OF PRIOR ART REFERENCE (37 CFR 1.56(a))

The following reference is cited to show the state of the art:

Japanese Patent Application Kokai Laid-Open No. 157044/75 based on the U.S. Ser. No. 470,213 filed on May 15, 1974 now abandoned.

BACKGROUND OF THE INVENTION

1. Field of the Invention

The present invention relates to a constant current circuit, and more particularly to a current source type constant current circuit which is suited to implement in a semiconductor integrated circuit.

2. Description of the Prior Art

In a current source type constant current circuit, constant current is basically derived from a collector current of a PNP transistor operated in an active resin.

FIG. 1 shows a basic circuit configuration for driving a gate of a PNPN switch used for a speech path switch or the like, with a constant current. In FIG. 1, numeral 1 denotes a PNPN switch, A and K an anode and a cathode, respectively, of the PNPN switch 1, $R_1$ and $R_2$ resistors $Q_1$ a PNP transistor, $D_1$ a diode, E a power supply and SW a switch. In this circuit arrangement, when the switch SW is closed, if a negative voltage is applied to the cathode K of the PNPN switch, a constant current is supplied from the collector of the PNP transistor $Q_1$. A collector current $I_{CQ1}$ of the PNP transistor $Q_1$ at this time can be approximated by:

$$I_{CQ1} = \frac{E - V_{BEQ1}}{R_2} \alpha_{Q1} \quad (1)$$

where E is a power supply voltage, $V_{BEQ1}$ is a base-emitter forward voltage of the transistor $Q_1$ (which is approximately equal to 0.7 volts), and $\alpha_{Q1}$ is a grounded base current gain of the transistor $Q_1$.

However, when the circuit is to be implemented in a semiconductor integrated circuit, particularly in a high breakdown voltage semiconductor integrated circuit, the grounded base current gain $\alpha_{Q1}$ shown in the equation (1) varies with manufacturing process and hence the resultant constant current significantly varies.

More particularly, in the semiconductor integrated circuit, the PNP transistor is usually a lateral transistor the current gain of which is as small as 0.3 to 0.7. Moreover, the lateral transistor is apt to be affected by surface condition of the device and hence the current gain changes significantly. Particularly when a high breakdown voltage PNP transistor is to be manufactured, an impurity concentration in a base region must be low. As a result, it is readily affected by the surface condition. Furthermore, in order to meet the requirement of high breakdown voltage, a base width must be increased. This results in small current gain (about 0.3). Because of this variation of the current gain, the magnitude of the constant current significantly changes.

As an approach to resolve the above drawbacks, a circuit configuration has been proposed in which an NPN transistor $Q_2$ (not shown) which is easy to attain a high current gain is Darlington-connected to the PNP transistor $Q_1$ to obtain a high equivalent current gain for minimizing the variation of the magnitude of the constant current due to the variation of the current gain.

However, this circuit configuration poses the following problems depending on the application thereof. First, when it is used in a high breakdown voltage application, the NPN transistor which is used to increase the current gain cannot provide a sufficient collector-emitter breakdown voltage because of its narrow base width (in longitudinal direction). Namely, the requirement of high current gain is incompatible with the requirement of high breakdown voltage. Secondly, when the circuit is used in a circumstance where a transient voltage is applied to the output of the constant current circuit when the transistor is non-conductive, a junction capacitance is amplified by the NPN transistor with a Miller effect so that a large transient current may flow.

SUMMARY OF THE INVENTION

It is an object of the present invention to provide a current source type constant current circuit which is suited for the implementation in a semiconductor integrated circuit, and has small variation in the magnitude of the constant current even when a current gain is small and includes large variation.

It is other object of the present invention to provide a current source type constant current circuit which can readily attain high breakdown voltage.

It is a further object of the present invention to provide a current source type constant current circuit which produces a small transient output current when a transient voltage is applied to the output.

According to the present invention, a constant current circuit is provided which comprises at least two PNP transistors having common-connected emitters and common-connected bases and connected to a constant voltage source, and an NPN transistor. A constant current is taken out of a collector of a first PNP transistor, the collector of the second PNP transistor and the base of the NPN transistor are connected together, and the common connected emitters of the first and second PNP transistors are connected to the collector of the NPN transistor.

DESCRIPTION OF THE PREFERRED EMBODIMENTS

Figure 1:
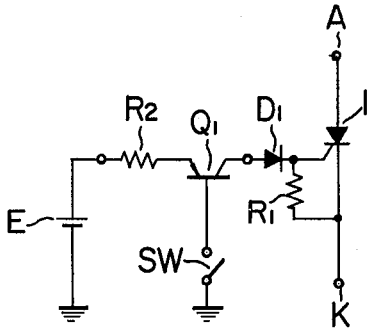
FIG. 1 is a circuit diagram illustrating a prior art current source type constant current circuit.
Figure 2:
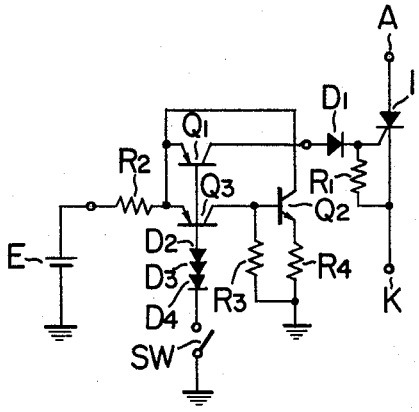
FIG. 2 is a circuit diagram illustrating a first embodiment of the present invention.

FIG. 2 shows a circuit diagram illustrating a first embodiment of the present invention, in which $Q_1$ and $Q_3$ denote first and second PNP transistors having emitters and bases common-connected, respectively, $Q_2$ denotes an NPN transistor for negative feedback, $R_1$, $R_2$, $R_3$ and $R_4$ denote resistors, 1 denotes a PNPN switch, A and K denote an anode and a cathode, respectively, of the PNPN switch 1, $D_1$ denotes a diode, $D_2$, $D_3$ and $D_4$ denote level shifting diodes, E denotes a power supply and SW denotes a switch. In the circuit arrangement described above, when the switch SW is closed, if a negative voltage is applied to the cathode K of the PNPN switch 1, a constant current is derived from the collector of the PNP transistor $Q_1$. The variation of the magnitude of the constant current is minimized by adjusting the amount of feedback of the feedback circuit in accordance with the variation of the current gain of the PNP transistor $Q_1$ due to the variation of the manufacturing process. More particularly, a portion of the collector current of the PNP transistor $Q_3$ having the base and emitter commonconnected to the base and emitter of the PNP transistor $Q_1$ flows into the base of the NPN transistor $Q_2$, which in turn bypasses a portion of current flowing into the emitters of the PNP transistors $Q_1$ and $Q_3$ through the resistor $R_2$, in accordance with the base current of the NPN transistor $Q_2$. Accordingly, where the two PNP transistors $Q_1$ and $Q_3$ have correlated current gains such as in the case where the transistors $Q_1$ and $Q_3$ are fabricated on a common chip of a semiconductor integrated circuit, it is possible to adjust the circuit such that the constant current $I_{CQ1}$ derived from the collector of the PNP transistor $Q_1$ is maintained to a constant magnitude even if the absolute value of the current gain changes. In the prior art circuit shown in FIG. 1, as the current gains of the PNP transistors $Q_1$ and $Q_3$ increase, those portions of the emitter currents which are taken out of the collectors increase and hence the output current $I_{CQ1}$ increases accordingly. On the other hand, in the circuit of the present invention shown in FIG. 2, when the collector current of the PNP transistor $Q_3$ increases, the base current of the PNP transistor $Q_2$ increases and hence the collector current thereof also increases. This serves to reduce that proportion of the constant current flowing through the resistor $R_2$ which is to be added to the emitter currents of the transistors $Q_1$ and $Q_3$. Accordingly, the constant current taken out of the collector of the PNP transistor $Q_1$ is maintained at a constant magnitude because the circuit is adjusted such that the emitter currents themselves decrease even when the current gains increases to increase those portions of the emitter currents which are taken as the collector currents.

The above relation is now quantitatively analyzed using simple equations. The collector current $I_{CQ1}$ of the PNP transistor $Q_1$ is determined in the following manner. Since the transistor $Q_2$ is of NPN type, $\beta_{Q2}$ is much greater than 1 ($\beta_{Q2} >> 1$). Assuming that forward voltage drops of the PN junctions are all aqual, that is, $V_{BEQ1} \approx V_{BEQ2} \approx V_{BEQ3} \approx V_{FD2} \approx V_{FD3} \approx V_{FB4} = V_F$, then;

$$I_{CQ3} = \frac{\alpha_{Q3}}{\alpha_{Q1}} I_{CQ1} \tag{2}$$

$$R_3 \cdot I_{CQ3} = V_{BEQ2} + I_{eQ2} \cdot R_4 \tag{3}$$

$$I_{R2} = \frac{E - (V_{BE} + V_{FD2} + V_{FD3} + V_{FD4})}{R_2} \tag{4}$$

$$I_{eQ2} = I_{R2} - I_{eQ1} \tag{5}$$

From the equations (2), (3), (4) and (5), $$\frac{\alpha_{Q3}}{\alpha_{Q1}} E_{CQ1} \cdot R_3 \approx V_F + \left(\frac{E - 4V_F}{R_2} - \frac{I_{CQ1}}{\alpha_{Q1}}\right) R_4 \tag{6}$$

From the equation (6), $$I_{CQ1} = \left\{ V_F + \frac{R_4(E - 4V_F)}{R_2} \right\} \cdot \frac{\alpha_{Q1}}{\alpha_{Q3} \cdot R_3 + R_4} \tag{7}$$

For simplification purpose, assuming that E is sufficiently large, than;

$$I_{CQ1} \approx \frac{E}{R_2} \cdot \frac{\alpha_{Q1} \cdot R_4}{\alpha_{Q3} \cdot R_3 + R_4} \tag{8}$$

where $\beta$ is a grounded emitter current gain and $\alpha$ is a grounded base current gain.

The equation (8) shows that the collector current of the transistor $Q_1$ is determined as $$\left(\frac{\alpha_{Q1} \cdot R_4}{\alpha_{Q3} \cdot R_3 + R_4}\right)$$

fraction of the constant current ($E/R_2$) flowing through the resistor $R_2$, said gain being determined by the ratio of the current gains $\alpha_{Q1}$ and $\alpha_{Q3}$ of the transistors $Q_1$ and $Q_3$ and the ratio of the resistors $R_3$ and $R_4$. It shows that the circuit configuration is suitable for the application to the semiconductor integrated circuit where variation in absolute value of the characteristic may be large but variation in relative ratio is small.

Figure 3:
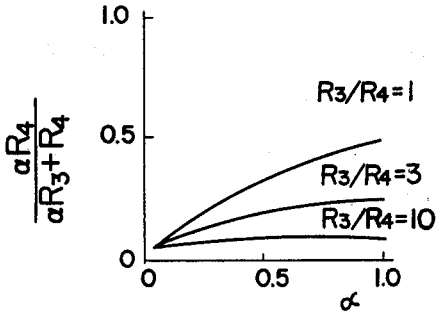
FIG. 3 shows an example of calculation of constant current for the variation of $\alpha$ in the construction of the present invention.

FIG. 3 shows plots of $\alpha$ vs $$\frac{\alpha \cdot R_4}{\alpha \cdot R_3 + R_4}$$

using $R_3/R_4$ as a parameter, where $\alpha_{Q1} = \alpha_{Q3} = \alpha$. As seen from FIG. 3, of the ratio $R_3/R_4$ is set to be sufficiently high, that is, if the amount of negative feedback of the transistor $Q_2$ is set to be sufficiently large, the variation of $$\left(\frac{\alpha \cdot R_4}{\alpha \cdot R_3 + R_4}\right)$$

to the variation of $\alpha$ is minimized.

Figure 4:
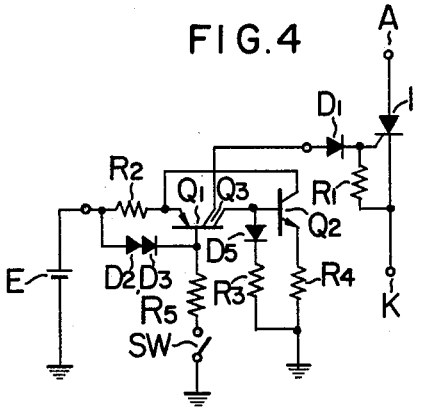
FIG. 4 shows a circuit diagram illustrating a second embodiment of the present invention.

FIG. 4 shows a circuit diagram illustrating a second embodiment of the present invention, in which $Q_1$ and $Q_3$ denote first and second PNP transistors of multicollector structure having emitters and bases commonconnected, respectively, $Q_2$ denotes an NPN transistor for negative feedback, $R_1$, $R_2$, $R_3$, $R_4$ and $R_5$ denote resistors, 1 denotes a PNPN switch, A and K denote an anode and a cathode of the PNPN switch 1, $D_1$ denotes a back-current blocking diode, $D_2$, $D_3$ and $D_5$ denote level shifting diodes, E denotes a power supply and SW denotes a switch. The circuit configuration is basically identical to that of FIG. 2. That is, the emitter current is adjusted by the action of the transistor $Q_2$ in accordance with the variation of the current gains of the transistors $Q_1$ and $Q_3$, to minimize the variation of the collector current $I_{CQ1}$. This circuit configuration is suited for the implementation in the semiconductor integrated circuit in which a drive circuit for driving the PNPN switch 1 is fabricated on the same chip as the PNPN switch 1. Namely, since the PNP transistors $Q_1$ and $Q_3$ are of multi-collector structure, isolation between the devices is not necessary and hence the space can be saved, and the correlation of the current gains is facilitated.

Furthermore, since the level shifting diodes $D_2$ and $D_3$ for providing the constant voltage are connected such that the potentials thereof are determined by the power supply E, the voltage range within which the transistors $Q_1$, $Q_2$ and $Q_3$ are operated in active region can be increased, to compare with FIG. 2, by adjusting the power supply voltage E. In addition, since the current flowing in the resistor $R_2$ is determined by the ratio of the forward voltage drop of the diodes $D_2$ and $D_3$ and the resistor $R_2$, the corelation of the manufacturing variation and temperature characteristic with gate firing sensitivity of the PNPN switch 1 is facilitated. Furthermore, since the diode $D_5$ is connected in series with the resistor $R_3$, the amount of feedback by the transistor $Q_2$ can be increased with smaller value of resistor $R_3$ than that in FIG. 2. This compensates for a drawback that a large area must be occupied to obtain a high resistance in the semiconductor integrated circuit.

It is apparent that the connection of the level shifting diodes $D_2$, $D_3$ and $D_5$ as shown in FIG. 4 may be applied to the circuit shown in FIG. 2.

Figure 5:
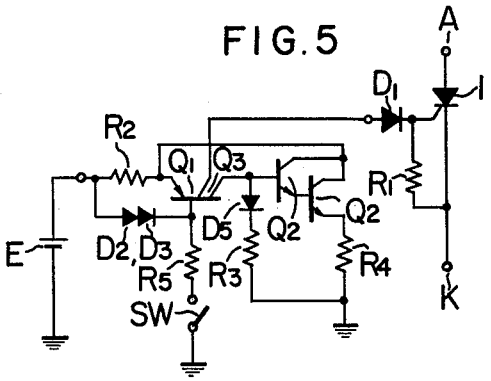
FIG. 5 shows a circuit diagram illustrating a third embodiment of the present invention.

FIG. 5 shows a third embodiment of the present invention, in which the NPN transistor $Q_2$ for negative feedback is Darlington-connected with an NPN transistor $Q_2'$ in order to attain higher current gain. Other elements are identical to those designated by the same reference characters in FIG. 4 and hence explanation with respect to the construction, operation and advantage is omitted here.

While the switch SW for operating the constant current circuit is connected to the base circuit of the PNP transistor in the embodiments of FIGS. 2, 4 and 5, it may be connected to the emitter circuit.

The switch SW may be an NPN transistor in the embodiments of FIGS. 2, 4 and 5 and may be a PNP transistor when it is connected to the emitter circuit.

While the forward characteristic of the level shifting diodes is utilized to obtain the constant voltage to derive the constant current in the above embodiments, backward zener characteristic of the diode or a transistor constant voltage circuit may be used.

By connecting an additional transistor in parallel with the parallel-connected transistors $Q_1$ and $Q_3$ shown in FIG. 2 or the multi-collector transistor $Q_1$ and $Q_3$ shown in FIGS. 4 and 5, or by using a multicollector transistor having a third collector, a multioutput constant current circuit is provided. The negative feedback transistor $Q_2$ may be basically supplied with a portion of the collector current of one of the PNP transistors as a base current and may has its collector connected to bypass the current flowing in the emitters of the PNP transistors. The Darlington connection as shown in FIG. 5 or any other modification may be used to obtain higher current gain.

As described hereinabove, according to the present invention, a current source type constant current circuit is provided which shows small variation of the magnitude of the constant current to the variation of the current gains of the PNP transistors. Since the output breakdown voltage of the constant current circuit is determined by the PNP transistor, higher breakdown voltage can be readily attained. Furthermore, since the PNP transistors having small current gains are used together with a negative feedback circuit, the transient output current is minimized. Thus, the current source type constant current circuit which is suited for use in a gate constant current drive circuit for a high breakdown voltage PNPN switch can be provided.

We claim:

1. A constant current circuit comprising: characteristic-correlated first and second PNP transistors having common-connected emitters and common-connected bases, and an NPN transistor whose base is connected to the collector of said second PNP transistor and whose collector is connected to said common-connected emitters of said first and second PNP transistors in which constant current is derived from the collector of said first PNP transistor.

2. A constant current circuit according to claim 1, wherein said first and second PNP transistors are formed by a multi-collector PNP transistor.

3. A constant current circuit according to claim 1, wherein a base resistor and an emitter resistor are connected to the base and the emitter, respectively, of said NPN transistor, the resistance of the base resistor being larger than the resistance of the emitter resistor.

4. A constant current circuit according to claim 1, wherein said NPN transistor comprises a pair of Darlington-connected NPN transistors.

5. A constant current circuit according to claim 2, wherein said NPN transistor comprises a pair of Darlington-connected NPN transistors.

6. A constant current circuit according to claim 3, wherein said NPN transistor comprises a pair of Darlington-connected NPN transistors.

7. A multi-output constant current circuit comprising:

a multi-collector PNP transistor having at least three collectors; and an NPN transistor whose base is connected to one of the collectors of said PNP transistor and whose collector is connected to the emitter of said PNP transistor, in which a plurality of constant currents are derived from the remaining collectors of said PNP transistor.

* * * * *